US005362064A

United States Patent [19]

Lofink et al.

[11] Patent Number: 5,362,064

[45] Date of Patent: Nov. 8, 1994

[54] MODIFIED BACCARAT

[76] Inventors: Richard Lofink; Kurt Lofink, both of P.O. Box 33388, Las Vegas, Nev. 89133

[21] Appl. No.: 118,012

[22] Filed: Sep. 8, 1993

[51] Int. Cl.[5] ..... A63F 1/00

[52] U.S. Cl. ..... 273/292; 273/274

[58] Field of Search ..... 273/274, 292

[56] References Cited

PUBLICATIONS

Scarne, J., *Scarne's Complete Guide to Gambling,* "Chemin de Fer and Baccarat", (New York:Simon and Schuster, 1974) pp. 413–431.

Scarne, J., *Scarne's Encyclopedia of Games,* "Chemin de Fer, Slogger and Scarney Baccarat" (New York-:Harper & Row, 1973) pp. 290–301.

Gibson, W. B., *Hoyle's Modern Encyclopedia of Card Games,* (New York:Doubleday and Co.) pp. 21–23, 63–65, 1974.

*Primary Examiner*—Vincent Millin

*Assistant Examiner*—William M. Pierce

*Attorney, Agent, or Firm*—John Edward Roethel

[57] ABSTRACT

A modified method of playing Baccarat is provided in which the conventional 5% commission charged by the gaming establishment on winning Bank hand wagers is eliminated. Preselected combinations of Bank and Player hands which would have been winning Bank hands under the conventional manner of play of Baccarat are treated as "push" or "bar" hands. The preselected combinations are chosen so that the gaming establishment maintains its desired percentage advantage over the bettor. In another embodiment, changes are made to the "third card draw rules" so that the Player's hand and the Bank's hand operate under the same criteria for whether a third card is or is not dealt to each respective hand. Separate mechanical or electrical devices can also be used to establish that a particular round of play of Baccarat would be a Bank hand "bar" round. Additionally, extra side wagers are added to the game. The bettor may make an additional wager that the hand will end in a tie, or that the "bar" hand will occur, or that a four card natural situation will occur or other additional combinations may occur during the play of the game. Appropriate odds are selected for each of these side bets. Additionally, one or more NO VALUE cards can be added to the standard deck of cards used in Baccarat. The NO VALUE card signals that if the Bank would normally have won that round, the Bank is barred from winning that round.

63 Claims, 4 Drawing Sheets

MODIFIED BACCARAT

This invention relates to a method of playing a modified version of baccarat, and more particularly to a method of playing baccarat in which the commission charged by the gaming establishment is eliminated.

BACKGROUND OF THE INVENTION

Baccarat is one of the many live table games played in casinos or gaming establishments. Baccarat uses a standard deck of 52 playing cards and is usually dealt from a shoe having multiple decks that have been shuffled together prior to the beginning of play.

The object of the game of Baccarat is for the bettor to successfully wager on whether the Bank's hand or the Player's hand is going to win. The bettor receives even money for his wager if he selects the winning hand and loses his wager if he selects the losing hand. Because of the rules of play of Baccarat, the Bank's hand has a slightly higher chance of winning than does the Player's hand. Therefore, if the bettor wagers on the Bank's hand, the bettor must pay to the gaming establishment a commission (typically, 5%) of the amount the bettor wins. No commission is paid if the bettor successfully wagers on the Player's hand.

As used in this specification, the term "Conventional Manner of Play of Baccarat" is as follows:

A multiple number of decks of standard playing cards, 52 in number, are used; typically eight decks are shuffled together and placed in a shoe from which the cards are dealt during the play of the game.

Each bettor makes a wager on whether the Bank's hand or the Player's hand will win. After all wagers are made, two cards are dealt from the shoe to the Bank position and two cards are dealt from the shoe to the Player position on the table layout. The cards are turned face up and the value of the Bank hand the Player hand is determined.

Aces count one; Kings, Queens, Jacks and Tens count zero and the other cards count their respective face value. The suits (Spades, Hearts, Diamonds and Clubs) have no meaning in Baccarat.

The highest hand value in Baccarat is nine. All hand values range from a low of zero to a high of nine. If when the cards are added together, the total of the hand exceeds nine, then the hand value is determined by subtracting ten from the total of the hand. For example, a seven and a eight total fifteen, but the hand value is five. An Ace and a nine total ten, but the hand value is zero.

A two card total of eight or nine is called a "natural"; a two card total of zero is called a "baccarat". As will be explained below, in certain situations in the play of the game, a third card will be dealt. The value of this third card is added to the total of the first two cards and a new hand value is established. Again, if the new hand total exceeds nine, the hand value is determined by subtracting ten from, the total of the hand.

Prior to the deal, each bettor can make one of three wagers: 1) that the Bank hand will win; 2) that the Player hand will win; or 3) that the Bank hand and the Player hand will tie. Wagering locations are provided on the Baccarat table layout. Whichever of the Bank hand or the Player hand is closest to a total on nine is the winner.

All winning Bank hand wagers are paid off at odds of one-to-one and the house charges a five percent (5%) commission (also known as the vigorish or the "vig") on the amount won by the bettor. For example, if a bettor wagers $100 on the Bank hand and the Bank hand wins, the bettor wins $100 and is charged a $5 "vig" on the amount that the bettor won. The bettor is not charged any "vig" on the amount of his wager.

All winning Player hand wagers are paid off at odds of one-to-one and the bettor is not charged any "vig" on the amount of his winnings or his wager. Winning wagers on the Tie hand bet are paid off at odds of nine-to-one or eight-to-one (depending on the gaming establishment) and the bettor is not charged any "vig" on the amount of his winnings or his wager. If a Tie hand occurs, all wagers on the Bank hand and all wagers on the Player hand are "pushes" and the amount wagered is returned to the bettor.

A typical Baccarat table layout is an oval with positions for the casino dealers along one side of the oval and usually twelve bettor locations, six at each end of the oval. The bettor locations are numbered one through twelve and each bettor location has an area designated for a wager on the Bank hand and an area designated for a wager on the Player hand. Locations are provided on the table layout where the cards comprising the Bank hand and the cards comprising the Player hand can be displayed. Also in the approximate center of the table layout are twelve "vig" boxes numbered one through twelve in which the casino dealers keep track of any commissions or vigorish owed to the gaming establishment by each player.

The play of Baccarat typically uses three casino dealers to operate the game. The casino dealers jointly participate in the shuffling of the eight decks of cards. After the shuffle is completed, one of the participants is asked to cut the decks using a plastic cut card. The dealer then separates and restacks the cards from the point of the cut and a participant then inserts the plastic cut card no less than fifteen cards from the end of the stacked decks and the entire stacked decks are placed into a shoe from which the cards are dealt during the play of the game. When the inserted plastic cut card appears during play, the hand in progress is completed and that round of play then ends. The cards are reshuffled to prepare for the next round of Baccarat.

At the beginning of a round of play and after the decks have been placed in the shoe, the dealer deals the first card from the shoe and turns it face up on the Baccarat table. The value of this card determines how many additional cards are removed or "burned" from the shoe before the actual play commences.

In conventional Baccarat, the bettors deal the cards used in the game. Initially, one of the casino dealers (called the "Caller") passes the shoe to the bettor sitting in seat number "1" at the Baccarat table. After all wagers have been made, the Caller tells the bettor with the shoe to begin the deal. The bettor deals a first card to the Caller, a first card to himself, a second card to the Caller and a second card to himself. All cards are dealt face down. The two cards given to the Caller represent the Player hand and the two cards kept by the bettor who is dealing the cards represent the Bank hand.

The Caller then allows one of the other bettors to turn up or "face" the Player's hand. Traditionally, this honor is given to the bettor who has made the largest wager. The bettor "faces" the two cards of the Player's hand and tosses them to the Caller. The Caller places these two cards face up in the table location designated for the "Player Hand" and the Caller announces the point total of the Player hand.

The bettor who has the shoe then "faces" the Bank hand and tosses these two cards to the Caller. The Caller places these two cards face up in the table location designated for the "Bank Hand" and the Caller announces the point total of the Bank hand.

Depending on the point total of the Player's hand and the Dealer's hand, one more card may be dealt to either the Player's hand, the Dealer's hand or both. The rules for determining whether a third card is dealt are fixed rules, there is no discretion for either the Player's hand or the Dealer's hand on whether a third card is dealt.

If either the Player hand or the Dealer hand has a point total of eight or nine on the first two cards, no third card is dealt to either hand and the hand with the highest point total is the winner (or the hand is a Tie, as the case may be). If neither the Player hand or the Dealer hand has a point total of eight or nine, then there is a possibility of a third card draw.

The third card draw rules are as follows:

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Bank hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

| Bank hand two card point total | Bank hand DRAWS when the Player's hand third card is: | Bank hand STANDS when the Player's hand third card is: |
|---|---|---|
| 0, 1 or 2 | Bank always draws | |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | | Bank always stands |

All third card draw determinations are automatically made by the Caller who is skilled in the game of Baccarat.

The complete winning hand rules and the third card draw rules of conventional Baccarat are set out graphically in Table 1. as follows:

TABLE 1

| BACCARAT ---RULES--- | | |
|---|---|---|
| PLAYER | | |
| HAVING TWO CARD TOTAL OF | | |
| 1-2-3-4-5-10 | DRAWS A CARD | |
| 6-7 | STANDS | |
| 8-9 | TURNS CARDS OVER | |
| BANKER | | |
| HAVING TWO CARD TOTAL OF | DRAWS WHEN GIVING OR PLAYER'S THIRD CARD DRAW IS AN | DOES NOT DRAW WHEN GIVING OR PLAYER'S THIRD CARD DRAW IS AN |
| 0, 1, 2 | ALWAYS DRAWS | |
| 3 | 1-2-3-4-5-6-7-9-10 | 8 |

TABLE 1-continued

| BACCARAT ---RULES--- | | |
|---|---|---|
| 4 | 2-3-4-5-6-7 | 1-8-9-10 |
| 5 | 4-5-6-7 | 1-2-3-8-9-10 |
| 6 | 6-7 | 1-2-3-4-5-8-9-10 |
| 7 | STANDS | |
| 8-9 | TURNS CARDS OVER | |

When the rules of Baccarat require a third card for the player hand, the Caller will request a "card for the Player." After the Player hand is completed, the Bank is completed in the same fashion. The Caller then declares which hand has the highest point total and declares that hand the winner (or the Caller declares a Tie hand as the case may be).

The bettor who is acting as the dealer continues to hold the deal until the Player hand wins. As soon as the Player hand wins, the shoe passes counterclockwise around the Baccarat table to the next bettor so that each bettor has the opportunity to deal the cards. Each bettor holds the shoe and continues to deal until the Player hand wins and then the shoe is passed to the next bettor. Any bettor may decline to deal the cards. The fact that one of the bettors is physically dealing the cards has no affect on the outcome of the game because the rules for drawing and standing do not allow any discretion on the part of the participants.

At the end of each hand, winning wagers are paid and losing wagers are collected by the house. Any "vig" due to the house is marked in the "vig" boxes in the center of the table layout. Gaming chips are used to represent the amount of money owed by each bettor to the house for the "vig". In order not to slow down the game, the "vig" is not actually collected from each bettor until the end of the round determined by all of the cards in the shoe being dealt down to the plastic cut card, usually approximately eighty hands.

The mathematical analysis of the game reveals that the 5% "vig" is what gives the house its advantage and allows the gaming establishment to make a profit from providing the Baccarat game to the bettors. Because the rules for standing and drawing third cards are automatic, the mathematical analysis shows that the Bank hand will win 45.8% of the hands, the Player hand will win 44.6% of the hands and the Tie hand will occur 9.6% of the hands. If the Tie hands are disregarded because they do not affect any Player or Bank wagers, it is then determined that the Bank hand will win 50.7% of the time and the Player hand will win 49.3% of the time.

Because the Bank hand wins more than 50% of the hands (disregarding the Tie hands that do not affect any Player or Bank wagers), if a bettor always bet on the Bank hand, the bettor would have an advantage over the gaming establishment. By charging a 5% "vig" on all Bank hand wins, the gaming establishment compensates for the percentage of winning Bank hands being slightly over 50%.

After figuring in the 5% "vig" that must be paid by bettors on winning Bank hands, the gaming establishment has a 1.23% advantage over the bettor when the bettor wagers on the Player hand and the gaming establishment has a 1.06% advantage over the bettor when the bettor wagers on the Bank hand. The Tie hand wager gives the gaming establishment a 4.88% advantage over the bettor when the payoff odds are nine-to-one and a 14.1% advantage over the bettor when the payoff odds are eight-to-one.

One of the detriments of the conventional manner of play of Baccarat is the necessity for calculating, recording and collecting this 5% "vig" on all winning Bank hand wagers. Many people are reluctant to sit down and participate because they do not understand the "vig" and why they should have to pay a 5% commission on winning Bank hand wagers. They may consider this unfair and something extra for the gaming establishment.

The gaming establishments also suffer disadvantages from the 5% commission. The determination of the 5% amount is done visually by a casino dealer and is subject to casino dealer error and disputes with the bettors over the amount of the "vig". The reconciliation and collection of the "vig" at the end of each shoe can result in delays of the beginning of the next round of play. If a bettor loses all of his money ("taps out") during a round of the game, the gaming establishment may have difficulty collecting the unpaid "vig" that has accrued to that bettor during that round of the game. It has been estimated that as much as twenty percent of the accrued "vig" goes uncollected. Because the house margin on Baccarat is so small, uncollected "vig" can seriously impact the profitability of a Baccarat table or the entire Baccarat pit, if more than one table is in play.

Another detriment of the conventional manner of play of Baccarat is the complexity of the "third card" draw rules. These complicated rules deter new bettors from participating in the play of Baccarat.

From the perspective of the gaming establishment, the play of a round of Baccarat should take a predictable length of time. An average of eighty hands are possible per each round of a shoe of eight decks of cards. During the play of each hand, the Player hand and the Dealer hand are dealt. According to the rules of Baccarat, each Player hand and Dealer hand may receive a third card. Winning wagers are paid and losing wagers are collected. The "vig" must be determined and recorded for each winning Bank hand wager. Because approximately half of the time the Bank hand will be the winning hand, it can be very time consuming toward the end of each shoe to record and accrue the amount of the "vig". Anything that slows down the actual play of the game results in decreased revenues to the gaming establishment.

There is a need in the gaming industry to increase the amount of revenue being generated by Baccarat tables over a given period of time without simply requiring the bettor to increase the amount of his wager.

It is an object of the present invention to provide a modified method of play of conventional Baccarat that increases the number of hands that can be dealt and played in a given length of time.

It is a further object of the present invention to provide a modified method of play of conventional Baccarat that eliminates the need for the gaming establishment to collect a commission or vigorish during the play of the game.

It is a further object of the present invention to provide a modified method of play of conventional Baccarat that simplifies the "third card draw rules" thus mitigating the possibility that dealer errors will occur in determining when and when not to deal a third card to either the Player or the Bank. Also new players will not have any difficulty understanding the "third card draw rules".

It is a further object of the present invention to provide a modified method of play of conventional Baccarat that permits additional wagering opportunities during the play of the game without slowing the game down.

It is a feature of the present invention to eliminate the collection of a commission or vigorish on each winning Bank hand or on any winning wager made during the play of Baccarat.

It is a further feature of the present invention to provide that certain card combinations that would have been winning hands in conventional Baccarat are now simply push hands for which the bettor only receives his original wager back.

It is a further feature of the present invention to provide that the "third card draw rules" are the same for the both the Player's hand and the Bank's hand. This simplifies the game and mitigates against the Dealer making mistakes during the play of a hand of Baccarat. Also new players will not have any difficulty understanding the "third card draw rules".

It is a further feature of the present invention to provide additional betting opportunities so that the bettor may wager that certain card combinations will occur during the play of a hand of Baccarat.

It is an advantage of the present invention that revenues to the gaming establishment will increase because more hands of the game can be played in a given length of time.

It is a further advantage of the present invention that the elimination of the commission or vigorish on the winning Bank hand wager will eliminate casino dealer errors and patron disputes regarding the amount of the vigorish and that revenue will not be lost when a player taps out without paying the accrued vigorish.

It is a further advantage that the simplified "third card draw rules" will speed up the play of a hand of Baccarat, will increase revenues generated for the gaming establishment, will encourage participation by new bettors and will cut down on the number of wrongly dealt hands.

It is a further advantage of the present invention that, by permitting additional wagers to be made that certain card combinations will appear during the play of each hand, the activity at the game of Baccarat will be increased resulting in additional revenues to the gaming establishment. The bettor will also receive additional opportunities to win during the play of the game.

Other objects, features and advantages of the present invention will become apparent from a consideration of the following detailed description.

SUMMARY OF THE INVENTION

A modified method of playing Baccarat is provided in which the conventional 5% commission charged by the gaming establishment on winning Bank hand wagers is eliminated. In its place, preselected combinations of Bank and Player hands which would have been winning Bank hands under the conventional manner of play of Baccarat are treated as "push" or "bar" hands. In one preferred embodiment, if the Bank hand is a "natural" and the Player hand is a "baccarat", all wagers made on the Bank hand would be a "push" and all wagers made on the Player hand would lose. The preselected combinations are chosen so that the gaming establishment maintains its desired percentage advantage over the bettor.

In another embodiment, changes are made to the "third card draw rules" so that the Player's hand and the Bank's hand operate under the same criteria for whether a third card is or is not dealt to each respective hand. In the preferred mode of this embodiment, if either the Player's hand or the Bank's hand has a point total of eight or nine, no third card is dealt to either hand; both the Player's hand and the Bank's hand stand on two card counts or six or seven and draw on two card counts of five or less. The winning hand is determined by which hand is closest to the point total of nine. In this embodiment, the Player hand and the Bank hand are symmetrical with neither hand winning or losing more often than the other hand; neither side having an advantage for the gaming establishment. The advantage for the gaming establishment is created by using "push" or "bar" hands for both the Player hand and the Bank hand. In one preferred embodiment, the "push" or "bar" hand could be when either the Player hand or the Bank hand has a winning total of 6 vs. 0. This combination produces a statistical house percentage of 1.15% on both the Player hand and the Bank hand.

Either of the above two versions could be modified by using devices other than card point totals to establish a "push" or "bar" situation for what would otherwise be a winning hand. For example, separate mechanical or electrical devices can be used to establish that a particular round of play of Baccarat would be a winning hand "bar" round, i.e. a normal winning hand would be barred from winning during that particular round of Baccarat and instead would become a "push" hand. In one form of mechanical device, three dice are placed in a dice cup. Any suitable symbols can be used on the faces of each die and one of the dealers or a bettor rolls the dice at the beginning of the play of the round of Baccarat. Preselected combinations are designated as Bank hand "bar" combinations. The dice would be exposed at the end of the play of the hand or, alternatively, the dice roll could be delayed until the end of the play of the hand.

Another suitable mechanical device would be a Baccarat Bar Wheel. Designated locations are established on the wheel as Bank hand "bar" locations while all other locations are designated as "no bar" locations. The wheel is spun to determine whether that particular round of play of Baccarat will be a "bar" hand for otherwise normally winning hands. Instead of utilizing mechanical devices such as dice or a wheel, any suitable electronic device using a random determinator could be used to establish whether the particular round of play of Baccarat is to be a winning hand "bar" round.

Another suitable device that can be used to establish a winning hand "bar" situation can be the use of one or more NO VALUE cards added to the standard deck of cards used in Baccarat. The NO VALUE cards are marked both on the face and the back of the card so that they are easily identifiable as they are dealt out of the shoe. When a NO VALUE card appears during the play of a round, the NO VALUE card signals that if the Bank would normally have won that round, the Bank is barred from winning that round. Because the gaming establishment does not have to pay winning Bank hands and collects losing Player hands on that round, the gaming establishment receives a definable percentage from the use of the NO VALUE cards. By increasing or decreasing the number of NO VALUE cards in a standard Baccarat deck, the gaming establishment can change the hold percentage of the game.

Additionally, extra side wagers are added to the game. The bettor may make an additional wager that the hand will end in a tie, or that the "bar" hand will occur, or that a four card natural situation will occur or other additional combinations may occur during the play of the game. Appropriate odds are selected for each of these side bets.

DETAILED DESCRIPTION OF THE PREFERRED EMBODIMENTS

Figure 1:
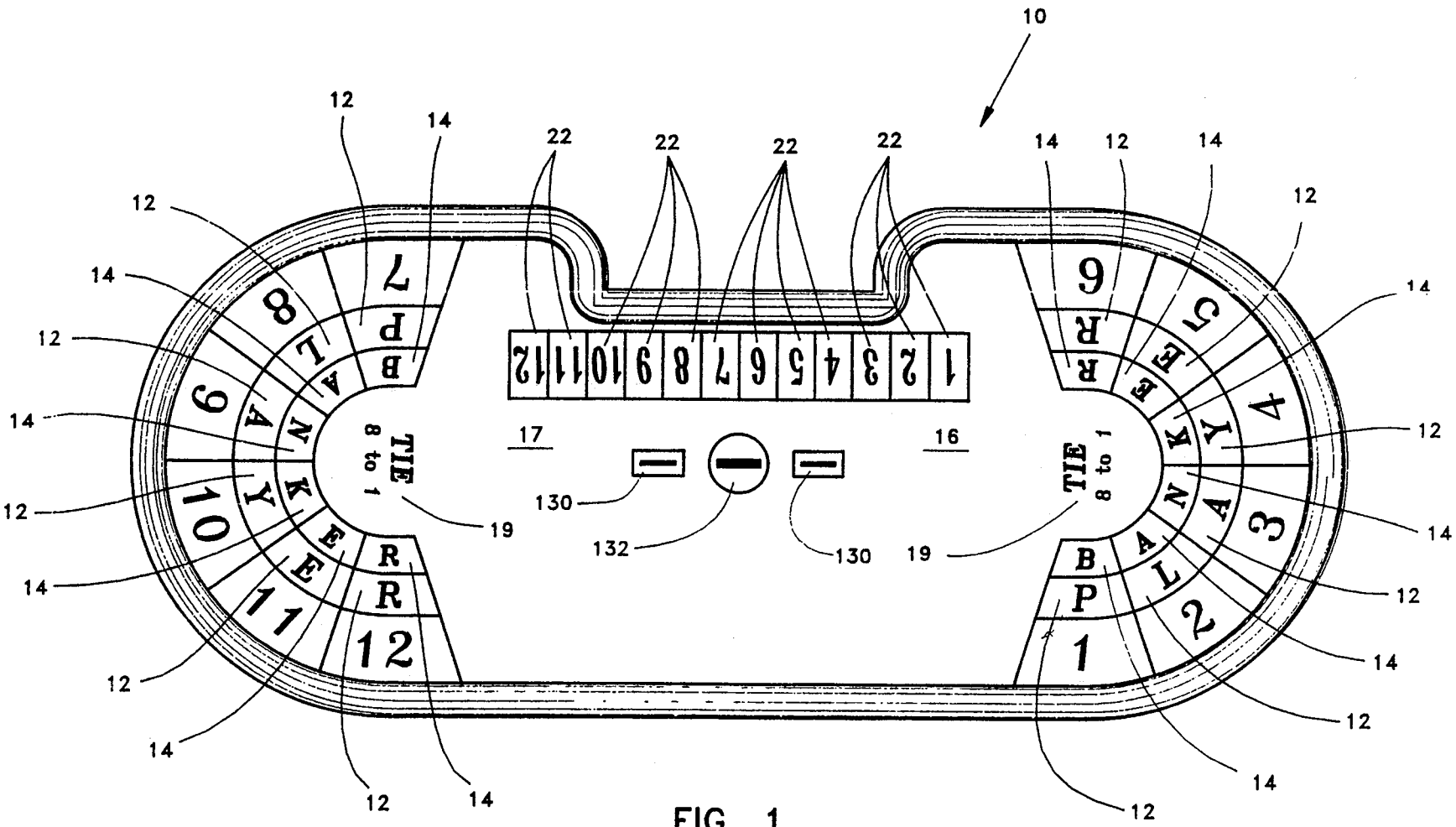
FIG. 1 shows a gaming table layout used in a conventional game of Baccarat.

A standard Baccarat layout is shown generally at 10 in FIG. 1. The Baccarat table layout 10 is usually an oval with positions for the casino dealers along one side of the oval and usually twelve bettor locations, six located at each end of the oval. The bettor locations are numbered one through twelve. Each bettor location has an area designated for a wager on the Bank hand 14 and an area designated for a wager on the Player hand 12. There is provided an area 16 where the cards comprising the Bank hand and an area 17 where the cards comprising the Player hand can be displayed. An area 19 is provided in which bettors may wager that a "Tie" hand will occur. Also in the approximate center of the table layout are twelve "vig" boxes 22 numbered one through twelve in which the casino dealers keep track of any accrued commissions or vigorish owed to the gaming establishment by each player. Adjacent to the casino dealers' location, there is normally provided one or more drop slots 130 into which the cash exchanged by the gaming establishment for chips is placed. Also provided is a discard bowl 132 for collecting the discarded cards at the end of each round of play.

The present invention eliminates the collection of a commission by the gaming establishment during the play of Baccarat. Various modifications to the "Conventional Manner of Play of Baccarat" will now be explained that eliminate the use of commissions.

Version 1

Figure 2:
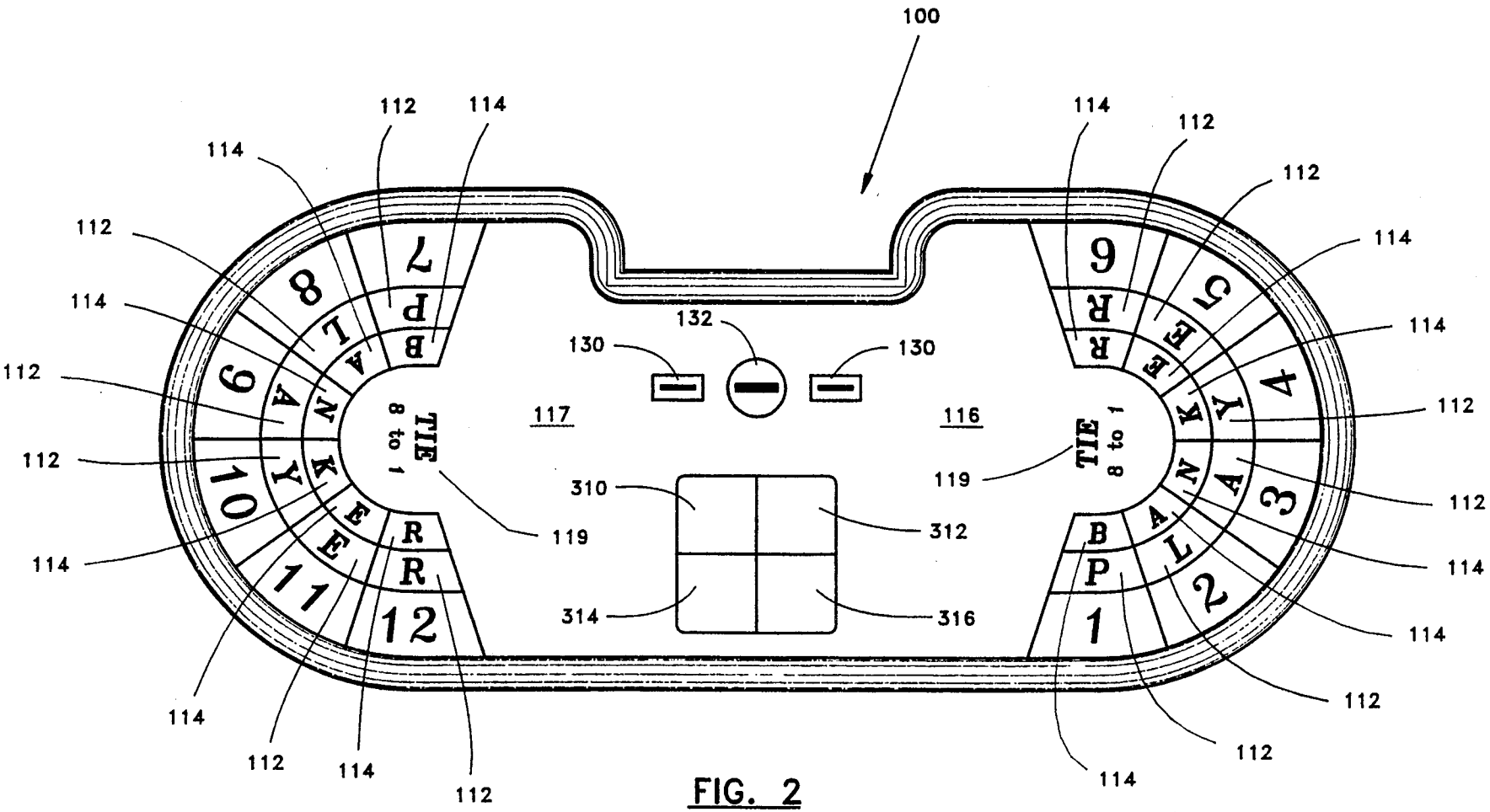
FIG. 2 shows a gaming table layout used in the modified method of Baccarat of the present invention; in this Version 1, the commission box is eliminated and locations are provided for additional side wagers.

FIG. 2 shows a Baccarat layout generally at 100 that has been modified to practice the present invention. The modified layout 100 has the usual twelve bettor locations around the two ends of the table. The bettor locations are numbered one through twelve. Each bettor location has an area designated for a wager on the Bank hand 114 and an area designated for a wager on the Player hand 112. There is provided an area 116 where the cards comprising the Bank hand and an area 117 where the cards comprising the Player hand can be displayed. An area 119 is provided in which bettors may wager that a "Tie" hand will occur. Adjacent to the casino dealers' location, there is normally provided one or more cash drop slots 130 and a discard bowl 132 for collecting the discarded cards at the end of each round of play.

Eliminated from the table layout are the twelve "vig" boxes in which the casino dealers previously kept track of any accrued vigorish owed to the gaming establishment. In this Version 1, the "third card draw rules" from the conventional manner of play of Baccarat are used.

In this Version 1, the use of a commission in Baccarat is eliminated and replaced with "push" or "bar" hands. The "push" or "bar" hands are chosen from hands that normally would have been winning Bank hands, but instead become "push" hands. In that situation, the gaming establishment does not have to pay winning Bank hands and collects losing Player hands on that round. Therefore the gaming establishment receives a definable percentage from the use of the "push" or "bar" hands. By increasing or decreasing the number of "push" or "bar" hands, the gaming establishment can change the hold percentage of the game.

There are several statistically valid card combinations that create a hold percentage approximately equal to the hold percentage of the Conventional Manner of Play of Baccarat created by the 5% commission. For example, the Bank hand would normally win if the Bank hand is a "natural" (i.e. the total of the first two Bank cards is eight or nine) and the Player hand is a "baccarat" (i.e. the total of the first two Player cards is zero). By changing this combination from "bank wins" to "bank pushes" the gaming establishment avoids paying out to winning Bank hand bettors an amount approximately equal to the normal 5% commission that would have been collected on winning Bank wagers.

The stated example has the advantage of being decided on the initial deal of the cards before any additional cards are drawn and the stated example is quite easy to explain to Baccarat bettors. Because Baccarat bettors are accustomed to having a commission charged on winning Bank hand wagers, it is only a minor inconvenience to the bettor to have these two normally winning Bank hands changed to "push" or "bar" hands, especially with the removal of commission collection on any other normally winning Bank hand.

Other statistically valid card combinations can also be used as "push" or "bar" hands and are intended to fall within the scope of the present invention. In the preferred embodiment of the present invention, the hand or hands that are chosen as "push" or "bar" hands should be selected on the basis of statistically matching in frequency the elimination of the normal 5% commission.

The following tables show various card combinations of the Bank's hand and the Player's hand that can be used as "bar" hands in the practice of the present invention. Each of these combinations would have normally been winning Bank hands, but are now"push" hands in which those wagering on the Bank hand"push" their bet while those wagering on the Player hand lose their bet. Each of these various card combinations represent a percentage hold to the gaming establishment approximately equal to the percentage hold effected by the 5% commission collected on winning Bank hand wagers under the conventional manner of play of Baccarat.

Table 2 shows "bar" hands using the total count of the Bank hand. In order to approximate the percentage hold found in the commission manner of play of Baccarat, a gaming establishment can select any one of the matched Bank hand totals and Player hand totals shown in Table 2:

TABLE 2

| BARS USING BANK HAND TOTALS<br>Winning Bank hand is barred when totals are: | |
|---|---|
| BANK HAND TOTAL IS: | PLAYER HAND TOTAL IS: |
| 9 or 8 (two cards only) | 0 |
| 9 (two or three cards) | 2, 3 |
| 8 (two or three cards) | 1, 2 |
| 7 (three cards only) | 0, 1, 2, 3, 4, 5, 6 |
| 6 (two cards only) | 0, 1, 2, 3 |
| 5 (two cards only) | 0, 1, 2, 3 |
| 4 (two or three cards) | 0, 1, 2 |
| 3 & 2 (two or three cards) | 0, 1, 2 |
| 1 & 2 & 3 & 4 (two or three cards) | 0 |

Table 3 shows "bar" hands using colors. Whenever the Bank winning hand consists of cards of all of the same color (whether it is a two card hand or a three card hand), the Bank winning hand is barred if a predetermined Bank hand total and Player hand total corresponds. In order to approximate the percentage hold found in the commission manner of play of Baccarat, a gaming establishment can select any one of the matched Bank hand total and Player hand totals shown in Table 3 which go into effect only when the Bank hand has cards of all the same color:

TABLE 3

| BARS USING COLORS (RED OR BLACK)<br>Bank winning hand has all cards of the same color<br>Winning Bank hand is barred when totals are | |
|---|---|
| BANK HAND TOTAL IS: (two or three card hands all same color) | PLAYER HAND TOTAL IS: |
| 9 | 0, 1, 2, 3 |
| 8 | 0, 1, 2, 3 |
| 7 | 0, 1, 2, 3, 4, 5 |
| 6 | 0, 1, 2, 3, 4, 5 |
| 1 & 2 & 3 & 4 | 0, 1, 2, 3 |

It is within the scope of the present invention to also establish as "bar" hands various combinations of winning Bank hand totals vs. losing Player hand totals where the Player hand is all the same color.

Table 4 shows "bar" hands using suits. Whenever the Bank winning hand consists of cards of all of the same suit (whether it is a two card hand or a three card hand), the Bank winning hand is barred if a predetermined Bank hand total and Player hand total corresponds. In order to approximate the percentage hold found in the Conventional Manner of Play of Baccarat, a gaming establishment can select any one of the matched Bank hand total and Player hand totals shown in Table 4 which go into effect only when the Bank hand has cards of all the same suit:

TABLE 4

| BARS USING SUITS ♣ ♦ ♥ ♠<br>Bank winning hand has all cards of the same suit<br>Winning Bank is barred when: | |
|---|---|
| BANK HAND TOTAL IS: (two or three card hands all same suit) | PLAYER HAND TOTAL IS: |
| 9 | 0, 1, 2, 3, 4, 5, 6, 7, 8 |
| 8 | 0, 1, 2, 3, 4, 5, 6, 7 |
| 1 & 2 & 3 & 4 & 7 | 0, 1, 2, 3, 4, 5, 6 |
| 4 & 5 & 6 | 0, 1, 2, 3, 4, 5 |

It is within the scope of the present invention to also establish as "bar" hands various combinations of winning Bank hand totals vs. losing Player hand totals where the Player hand is all the same suit.

Table 5 shows "bar" hands using pairs. Certain winning Bank hand totals are matched up with certain Player hand totals when the Player hand consists of a two card pair; and likewise certain Player hand totals are matched up with certain winning Bank hand totals when the Bank hand consists of a two card pair. In order to approximate the percentage hold found in the Conventional Manner of Play of Baccarat, a gaming establishment can designate all of the following combinations as "bar" hands:

TABLE 5

BARS USING PAIRS
Any winning Bank over a losing Player hand holding a two card pair and any two card winning Bank hand holding a pair over a losing Player hand is barred.
(All of the following combinations are used to make the bar).

| BANK HAND TOTAL IS: | PLAYER HAND TOTAL IS: |
|---|---|
| 7, 8, 9 | 6 (pair is 3, 3) |
| 7, 8, 9 | 6 (pair is 4, 4) |
| 9 | 8 (pair is 4, 4) |
| 9 | 8 (pair is 9, 9) |
| 4 (pair is 2, 2) | 0, 1, 2, 3 |
| 4 (pair is 7, 7) | 0, 1, 2, 3 |
| 6 (pair is 3, 3) | 0, 1, 2, 3, 4, 5 |
| 6 (pair is 8, 8) | 0, 1, 2, 3, 4, 5 |
| 8 (pair is 4, 4) | 0, 1, 2, 3, 4, 5, 6, 7 |
| 8 (pair is 9, 9) | 0, 1, 2, 3, 4, 5, 6, 7 |

Instead of using card combinations to determine winning Bank hand "bar" situations, separate mechanical or electrical devices can be used to establish that a particular round of play of Baccarat would be a Bank hand "bar" round, i.e. a normal winning Bank hand would be barred from winning during that particular round of Baccarat and instead would become a "push" hand.

In one form of mechanical device, three dice are placed in a covered dice cup. Any suitable symbols can be used on the faces of each die and one of the dealers or a bettor shakes the dice at the beginning of the play of the round of Baccarat, but the results of this shaking of the dice is not revealed until the completion of the play of the hand. Alternatively, the shaking of the dice can be performed at the end of the play of the hand.

One or more preselected combinations are designated as Bank hand "bar" combinations and the percentage retained by the gaming establishment can be controlled in accordance with the number of preselected combinations that are so designated.

In one preferred embodiment using standard die faces having 1 through 6 pips thereon, the Bank hand would be "barred" from being a winning hand whenever three of the same kind of pips are rolled for pips 1 through 5 or if the pips on the three dice add up to a count of five (e.g. three ①'s, three ②'s, three ③'s, three ④'s or three ⑤'s—three ⑥'s would not be a "barred" Bank hand or the three pips add up to a count of five such as ①-①-③ or ①-②-②). It can be shown mathematically that the use of these preselected combinations generate approximately the same gaming establishment percentage as was realized from the 5% commission used in the conventional manner of play of Baccarat. The normal play of the game of Baccarat is conducted and the dice are then checked to determine whether a Bank hand "bar" is in effect for that round of play. Other appropriate dice combinations can be selected as "barred" hand determining combinations with the percentage held by the gaming establishment dependent on the number and frequency of "bar" hands occurring.

Another suitable device would be a Baccarat Bar Wheel, either mechanical, electrical or both. The gaming establishment or the wheel manufacturer determines a suitable number of locations or stops on the wheel. Preselected locations or stops are established on the wheel as Bank hand "bar" locations with all other locations as "no bar" locations. In one preferred embodiment, the wheel is spun after completion of the round of play to determine whether that particular round of play will be a "bar" hand for otherwise normally winning Bank hands. In this preferred embodiment, the Baccarat Bar Wheel has forty locations or stops of which two locations are Bank hand "bar" locations and the remaining thirty-eight locations are "no-bar" locations. The preselected number of "bar" locations and "no-bar" locations have been chosen so that gaming establishment maintains its desired percentage advantage over the bettor and approximately replicates the percentage hold effected by the 5% commission that exists in the conventional manner of play of Baccarat. The gaming establishment can vary its percentage hold by varying the total number of locations on the Baccarat Bar Wheel and by varying the mix of the number of "bar" locations and "non-bar" locations.

Another suitable device that can be used to establish a winning hand "bar" situation can be the use of one or more NO VALUE cards added to the standard deck of cards used in Baccarat. In the preferred embodiment, the NO VALUE cards are marked differently on both the front and back of the cards to easily distinguish and identify these NO VALUE cards from the standard cards.

If a NO VALUE card appears during the play of the game of Baccarat, the NO VALUE card is set aside into a designated area on the table layout to indicate that any winning Bank hand, according to the Conventional Manner of Play of Baccarat, becomes a "bar" or "push" hand for this particular round of the game. The gaming establishment can control its winning percentage by increasing or decreasing the number of NO VALUE cards that are inserted into the standard deck of cards.

Instead of utilizing devices such as dice, a wheel or NO VALUE cards, any other suitable mechanical, electronic or electro-mechanical device using a random determinator could be used to establish whether the particular round of play of Baccarat is to be a Bank hand "bar" round. The device need only be able to be preset to generate a suitable mixture of "bar" hands and "non-bar" hands.

Version 2

Figure 3:
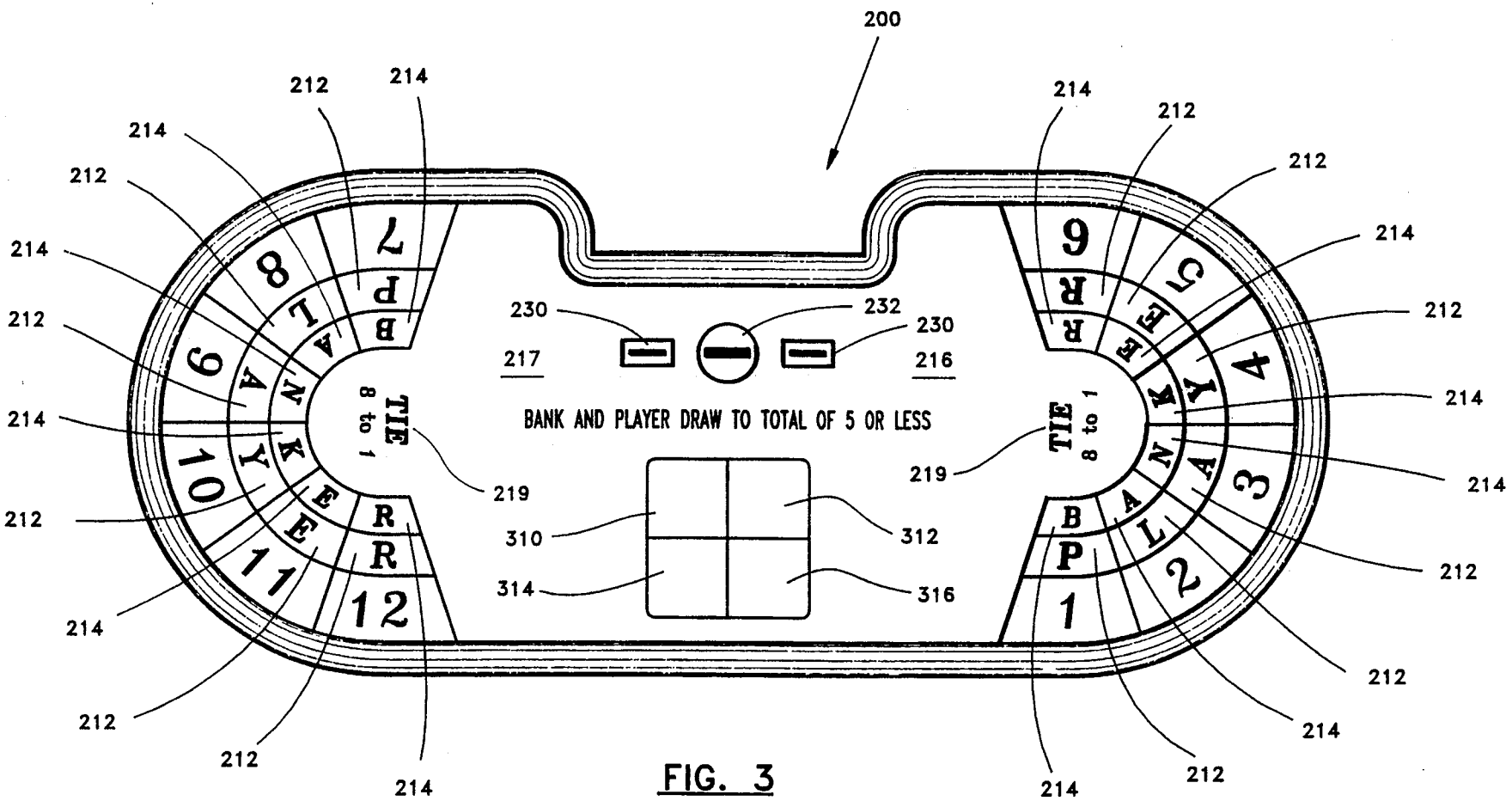
FIG. 3 shows a gaming table layout used in the modified method of Baccarat of the present invention; in this Version 2, the commission box is eliminated, locations are provided for additional side wagers and the new simplified "third card draw rules" are printed on the layout.
Figure 4:
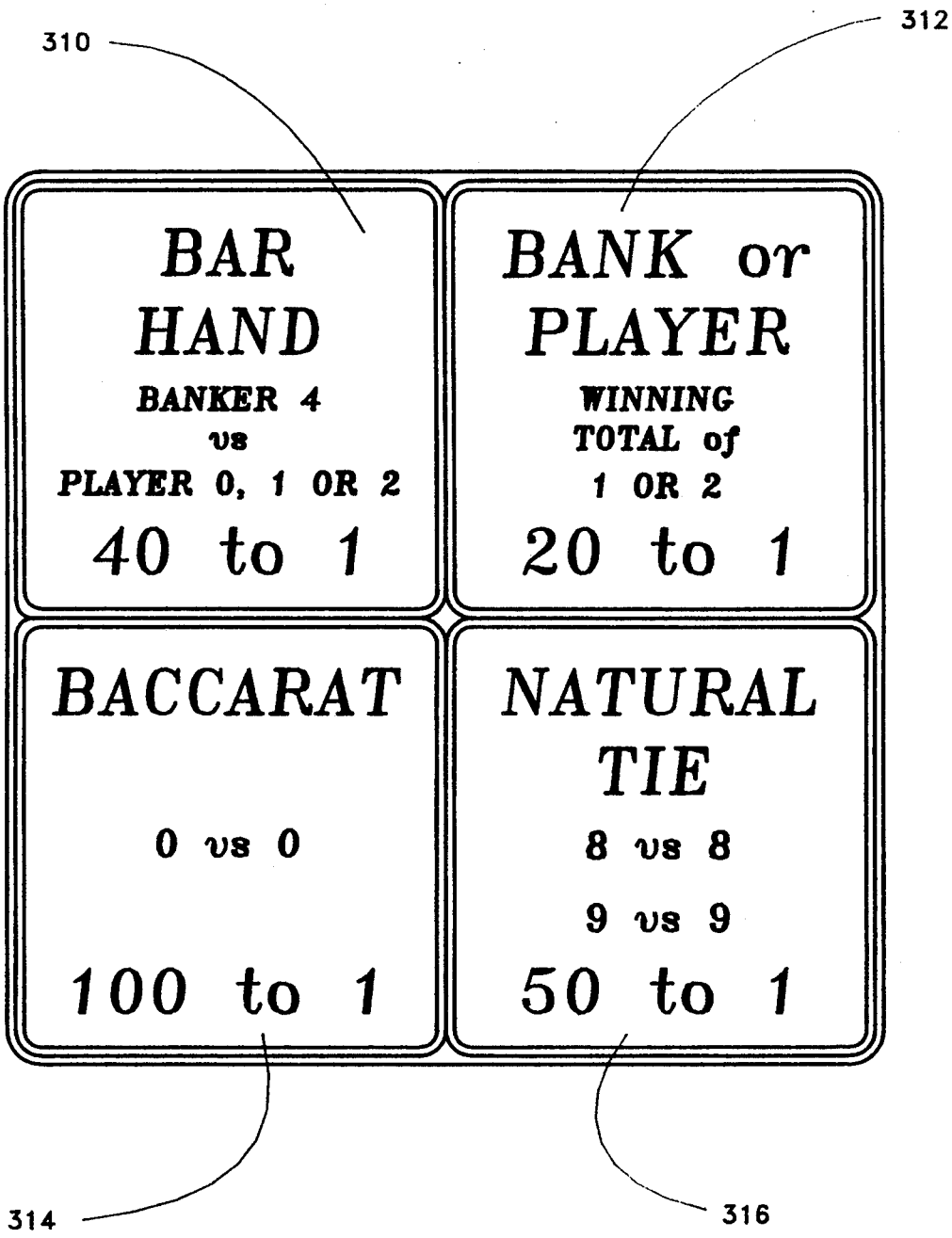
FIG. 4 shows an enlarged view of the layout that shows the various additional side wager bets and combinations that can be used in connection with the method of the present invention.

Version 2 uses the table layout shown in FIG. 3. The modified layout 200 has the usual twelve bettor locations around the table. The bettor locations are numbered one through twelve, six of which extend around each end of the table. Each bettor location has an area designated for a wager on the Bank hand 214 and an area designated for a wager on the Player hand 212. There is provided an area 216 where the cards comprising the Bank hand and an area 217 where the cards comprising the Player hand can be displayed. Adjacent to the casino dealers' location, there is normally provided one or more cash drop slots 230 and a discard bowl 232 for collecting the discarded cards at the end of each round of play.

Eliminated from the table layout are the twelve "vig" boxes in which the casino dealers previously kept track of any accrued vigorish owed to the gaming establishment. In this Version 2, the "third card draw rules" from the conventional manner of play of Baccarat are modified and simplified so that dealer error in applying the "third card draw rules" is eliminated and so that immediate understanding of the "third card draw rules" is accomplished by all bettors.

The Version 2 modified "third card draw rules" are as follows:

| | |
|---|---|
| | Bank hand two card point total |
| 8 or 9 | Natural (no draw for either hand) |
| 6 or 7 | Bank always strands |
| 5 or less | Bank always draws |
| | Player hand two card point total |
| 8 or 9 | Natural (no draw for either hand) |
| 6 or 7 | Player always strands |
| 5 or less | Player always draws |

This Version 2 modified "third card draw rules" are based solely on the two card total held by either the Bank hand or the Player hand. The point total of the two card Bank hand has no effect on whether the Player hand draws; the point total of the two card Player hand has no effect on whether the Bank hand draws. After either the Bank hand or the Player hand draws or not, the winning hand is determined by which hand is closest to the point total of nine.

In this Version 2, the use of a commission in Baccarat is also eliminated and replaced with "push" or "bar" hands for both the Player hand and the Bank hand. The "push" or "bar" hands are chosen from hands that normally would have been winning Player or Bank hands, but instead become "push" hands. In that situation, the gaming establishment does not have to pay winning Player hands and collect losing Bank hands or vice versa on that round. Therefore, the gaming establishment receives a definable percentage from the use of the "push" or "bar" hands. By increasing or decreasing the number of "push" or "bar" hands, the gaming establishment can change the hold percentage of the game.

There are a number of statistically valid card combinations that create a hold percentage approximately equal to the hold percentage of the Conventional Manner of Play of Baccarat. For example, a "push" or "bar" hand could be when either the Player hand or the Bank hand has a winning total of 6 vs. 0. This combination produces a statistical house percentage of 1.15% on both the Player hand and the Bank hand.

It is also within the scope of the present invention to use other combinations of Player hands and Bank hands as "push" or "bar" hands. In the preferred embodiment of the present invention, the hand or hands that are chosen as "push" or "bar" hands should be selected on the basis of statistically matching in frequency the elimination of the normal 5% commission, i.e. the gain to the gaming establishment generated by the Conventional Manner of Play of Baccarat.

The following tables show various card combinations of the Player's hands and Bank's hands that can be used as "bar" hands in the practice of the present invention. Each of these combinations would have normally been winning Player or Bank hands, but are now "push" hands in which those wagering on the Player hand "push" their bet while those wagering on the Bank hand lose their bet or vice versa. Each of these various card combinations represent a percentage hold to the gaming establishment approximately equal to the percentage hold under the Conventional Manner of Play of Baccarat.

Table 6 shows "bar" hands using the total count of the Player hand or the Bank hand. In order to approximate the percentage hold found in the Conventional Manner of Play of Baccarat, a gaming establishment can select any one of the matched Player hand totals and Bank hand totals shown in Table 6:

TABLE 6

| BARS USING BOTH PLAYER AND BANK HAND TOTALS | | | |
|---|---|---|---|
| Winning Player hand is barred when totals are: | | Winning Bank hand is barred when totals are: | |
| PLAYER HAND TOTAL IS: | BANK HAND TOTAL IS: | PLAYER HAND TOTAL IS: | BANK HAND TOTAL IS: |
| 9 (two or three cards) | 8 | 9 (two or three cards) | 8 |
| 8 (two or three cards) | 5 | 8 (two or three cards) | 5 |
| 7 (two or three cards) | 0 | 7 (two or three cards) | 0 |
| 6 (two or three cards) | 0 | 6 (two or three cards) | 0 |
| 5 & 4 (two or three cards) | 0 | 5 & 4 (two or three cards) | 0 |
| 3 & 2 (two or three cards) | 0 | 3 & 2 (two or three cards) | 0 |
| 2 & 1 (two or three cards) | 0 | 2 & 1 (two or three cards) | 0 |

Table 7 shows "bar" hands using colors. Whenever the Player hand consists of cards of all of the same color, the Player winning hand is barred if a predetermined Player hand total and Bank hand total corresponds; and vice versa, whenever the Bank hand consists of cards of all of the same color, the Bank winning hand is barred if a predetermined Bank hand total and Player hand total corresponds. In order to approximate the percentage hold found in the Conventional Manner of Play of Baccarat, a gaming establishment can select any one of the matched Player hand totals and Bank hand totals shown in Table 7:

TABLE 7

| BARS USING COLORS (RED OR BLACK) Bars for Both Player and Bank Hands | | | |
|---|---|---|---|
| Winning Player hand is barred when holding cards of the same color and totals are: | | Winning Bank hand is barred when holding cards of the same color and totals are: | |
| Player hand total is: | Bank hand total is: | Bank hand total is: | Player hand total is: |
| 9 (two cards same color) | 1 & 0 | 9 (two cards same color) | 1 & 0 |
| 8 (two cards same color) | 1 & 0 | 8 (two cards same color) | 1 & 0 |
| 7 (two cards same color) | 6 & 5 & 4 | 7 (two cards same color) | 6 & 5 & 4 |
| 6 (two cards same color) | 5 & 4 & 3 & 2 | 6 (two cards same color) | 5 & 4 & 3 & 2 |
| 6 & 5 (three cards same color) | 5 through 0 | 6 & 5 (three cards same color) | 5 through 0 |
| 4 & 3 & 2 (three cards same color) | 3 through 0 | 4 & 3 & 2 (three cards same color) | 3 through 0 |

Table 8 shows "bar" hands using suits. Whenever the Player hand consists of cards of all of the same suit, the Player winning hand is barred if a predetermined Player hand total and Bank hand total corresponds and vice versa, whenever the Bank hand consists of cards of all of the same suit, the Bank winning hand is barred if a predetermined Bank hand total and Player hand total corresponds. In order to approximate the percentage hold found in the Conventional Manner of Play of Baccarat, a gaming establishment can select any one of the matched Player hand totals and Bank hand totals shown in Table 8:

TABLE 8

| BARS USING SUITS ♣ ♦ ♥ ♠ Bars for Both Player and Bank Hands | | | |
|---|---|---|---|
| Winning Player hand is barred when holding cards of the same suit and totals are: | | Winning Bank hand is barred when holding cards of the same suit and totals are: | |
| Player hand total is: | Bank hand total is: | Bank hand total is: | Player hand total is: |
| 9 (two cards same suit) | 8 through 3 | 9 (two cards same suit) | 8 through 3 |
| 8 (two cards same suit) | 7 through 3 | 8 (two cards same suit) | 7 through 3 |
| 7 (two cards same suit) | 6 through 0 | 7 (two cards same suit) | 6 through 0 |
| 6 (two/three cards same suit | 5 through 0 | 6 (two/three cards same suit | 5 through 0 |
| 9 & 8 & 7 & 6 & 5 & 4 & 3 & 2 & 1 (three | 8 through 0 (losing hands) | 9 & 8 & 7 & 6 & 5 & 4 & 3 & 2 & 1 (three | 8 through 0 (losing hands) |

TABLE 8-continued

| BARS USING SUITS ♣ ♦ ♥ ♠ Bars for Both Player and Bank Hands | | | |
|---|---|---|---|
| Winning Player hand is barred when holding cards of the same suit and totals are: | | Winning Bank hand is barred when holding cards of the same suit and totals are: | |
| Player hand total is: | Bank hand total is: | Bank hand total is: | Player hand total is: |
| cards same suit) | | cards same suit) | |

Table 9 shows "bar" hands using pairs. Certain winning Player hand totals are matched up with certain Bank hand totals when the Bank hand consists of two card pair and certain Bank hand totals are matched up with certain winning Player hand totals when the Player hand consists of a two card pair. In order to approximate the percentage hold found in the Conventional Manner of Play of Baccarat, a gaming establishment can designate all of the following combinations as "bar" hands:

TABLE 9

| BARS USING PAIRS Any winning Player hand over a losing Bank hand holding a two card pair and Any winning Bank hand over a losing Player hand holding a two card pair. | | | |
|---|---|---|---|
| (All of the following combinations are used to make the bar) | | (All of the following combinations are used to make the bar) | |
| PLAYER HAND TOTAL IS: | BANK HAND TOTAL IS: | PLAYER HAND TOTAL IS: | BANK HAND TOTAL IS: |
| 9 through 3 | 2 (pair is 1, 1) | 9 through 3 | 2 (pair is 1, 1) |
| 9 through 5 | 4 (pair is 2, 2) | 9 through 5 | 4 (pair is 2, 2) |
| 9 & 8 & 7 | 6 (pair is 3, 3) | 9 & 8 & 7 | 6 (pair is 3, 3) |
| 9 | 8 (pair is 4, 4) | 9 | 8 (pair is 4, 4) |
| 9 through 1 | 0 (pair is 5, 5) | 9 through 1 | 0 (pair is 5, 5) |
| 9 through 3 | 2 (pair is 6, 6) | 9 through 3 | 2 (pair is 6, 6) |
| 9 through 5 | 4 (pair is 7, 7) | 9 through 5 | 4 (pair is 7, 7) |
| 9 & 8 & 7 | 6 (pair is 8, 8) | 9 & 8 & 7 | 6 (pair is 8, 8) |
| 9 | 8 (pair is 9, 9) | 9 | 8 (pair is 9, 9) |

Instead of using card combinations to determine winning Bank hand "bar" situations, separate mechanical or electrical devices can be used to establish that a particular round of play of Baccarat would be a Player hand "bar" or Bank hand "bar" round, i.e. a normal winning Player hand or Bank hand would be barred from winning during that particular round of Baccarat and instead would become a "push" hand.

In one form of mechanical device, three dice are placed in a covered dice cup. Any suitable symbols can be used on the faces of each die and one of the dealers or a bettor shakes the dice at the beginning of the play of the round of Baccarat, but the results of this shaking of the dice is not revealed until the completion of the play of the hand. Alternatively, the shaking of the dice can be performed at the end of the play of the hand.

One or more preselected combinations are designated as Player hand "bar" or Bank hand "bar" combinations and the percentage retained by the gaming establishment can be controlled in accordance with the number of preselected combinations that are so designated.

In one preferred embodiment using standard die faces having 1 through 6 pips thereon, the Player hand or the Bank hand would be "barred" from being a winning hand whenever three of the same kind of pips are rolled for pips 1 through 6 (e.g. three ①'s, three ②'s, three ③'s, three ④'s, three ⑤'s or three ⑥'s). It can be shown mathematically that the use of these six preselected combinations generate approximately the same gaming establishment percentage as was realized from the Conventional Manner of Play of Baccarat. After determining the winning hand, be it the Player hand or the Bank hand, the dice are then checked to determine whether the winning hand is "barred" for that round of play. Other appropriate dice combinations can be selected as "barred" hand determining combinations with the percentage held by the gaming establishment dependent on the number and frequency of "bar" hands occurring.

Another suitable device would be a Baccarat Bar Wheel, either mechanical, electrical or both. The gaming establishment or the wheel manufacturer determines a suitable number of locations or stops on the wheel. Preselected locations or stops are established on the wheel as "winning hand barred" locations with all other locations as "no bar" locations. In one preferred embodiment, the wheel is spun after all wagers have been placed to determine whether that particular round of play will be a "barred" hand for otherwise normally winning Player hands or Bank hands. In this preferred embodiment, the Baccarat Bar Wheel has fifty locations or stops of which one location is a "winning hand barred" location and the remaining forty-nine locations are "no-bar" locations. The preselected number of "winning hand barred" locations and "no-bar" locations have been chosen so that gaming establishment maintains its desired percentage advantage over the bettor and approximately replicates the percentage hold of the Conventional Manner of Play of Baccarat. The gaming establishment can vary its percentage hold by varying the total number of locations on the Baccarat Bar Wheel and by varying the mix of the number of "winning hand barred" locations and "no-bar" locations.

Another suitable device that can be used to establish a "winning hand barred" situation can be the use of one or more NO VALUE cards added to the standard deck of cards used in Baccarat. In the preferred embodiment, the NO VALUE cards are marked differently on both the front and back of the cards to easily distinguish and identify these NO VALUE cards from the standard cards.

If a NO VALUE card appears during the play of the game of Baccarat, the NO VALUE card is set aside into a designated area on the table layout to indicate that any winning Player hand or Bank hand, according to the Conventional Manner of Play of Baccarat, becomes a "bar" or "push" hand for this particular round of the game. The gaming establishment can control its winning percentage by increasing or decreasing the number of NO VALUE cards that are inserted into the standard deck of cards.

Instead of utilizing devices such as dice, a wheel or NO VALUE cards, any other suitable mechanical, electronic or electro-mechanical device using a random determinator could be used to establish whether the particular round of play of Baccarat is to be a Player hand or Bank hand "bar" round. The device need only be able to be preset to generate a suitable mixture of "bar" hands and "non-bar" hands.

Additional Modifications

Either Version 1 or Version 2 may include additional side bet options that the bettors may make at the beginning of each round of the game. A portion of gaming table layout is set aside to visually depict to each bettor the various side bet options. FIG. 5 shows a typical side bet area that can be displayed on the gaming table layout. Block 310 represents a side bet option that pays the bettor 40-to-1 odds on his wager if a particular "bar" hand comes up, viz. the Bank hand has a point total of 4 and the Player hand has a point total of either 0, 1 or 2. Block 312 represents a side bet option that pays the bettor 20-to-1 odds that the Bank hand or the Player hand will win the round with a point total of 1 or 2. Block 314 represents a side bet option that pays the bettor 100-to-1 odds that the round will end in a tie with the Bank hand and the Player hand each having a point total of zero. Block 316 represents a side bet option that pays the bettor 50-to-1 odds that the round will end in a tie with the Bank hand and the Player hand each having a "natural" (two card) point total of 8 vs. 8 or 9 vs. 9.

Besides the side bet propositions shown in FIG. 5, any one or combinations of the following additional side bets may be included in the method of the present invention and represented in the side bet portion of the gaming table layout shown in FIG. 5:

1. Bar: a "bar" or "push" hand will occur during that particular round of play of the game.
2. Same Color/Same Suit: all exposed cards during that particular play of the game will be either the same color or the same suit.
3. Any Natural: either the Bank hand and the Player hand will be a "natural" during that particular round of play of the game.
4. Natural 9 vs. 8: one hand will have a natural 9 and the other hand will have a natural 8 during that particular round of play of the game.
5. 9 vs. 8: one hand will have a 9 point total and the other hand will have an 8 point total during that particular round of play of the game.
6. Winning Hand Total: the numerical total of the cards of the winning hand during that particular round of play of the game (two or three cards).
7. Combined Hand Total: the numerical total of the cards of both hands during that particular round of play of the game (four, five or six cards).
8. Matched Pairs: the Bank hand and the Player hand will comprise a pair of the same cards during that particular round of play of the game.
9. Triplets Either Hand: either the Bank hand or the Player hand will comprise three of a kind of the same card during that particular round of play of the game.
10. Matched Triplets: the Bank hand and the Player hand will comprise three of a kind of the same cards during that particular round of play of the game.
11. Suited Winning Hand: the winning hand will have cards all of the same suit during that particular round of play of the game.
12. Over and Under: Whether the point total of the winning hand will be over or under a point total of five.

Appropriate odds are selected for each of these side bets or combinations of each of these side bets.

Side bets are also contemplated that have the payouts tied into a progressive jackpot. A separate side bet on either the Player's hand or the Bank's hand can be allocated to a progressive jackpot and if the Player's hand or the Bank's hand achieves a preselected arrangement of cards, the bettor can win either a portion or all of the progressive jackpot. The preselected arrangement of cards are based on the mathematical odds of certain card combinations appearing during the play of the Player's hand and the Bank's hand. The payouts from the progressive jackpot are also predetermined and can be a flat amount or a percentage of the progressive jackpot.

The addition of these side bet opportunities will also increase the appeal of Baccarat to the particpants wagering in the game and increase the revenue to the gaming establishment.

The method of the present invention can be practiced in either the live game version of Baccarat or in an electronic gaming machine version of Baccarat. An electronic gaming device can be programmed to display both the Player's hand and the Bank's hand and to allow a bettor to wager on either the Player's hand, the Bank's hand or a tie hand. The electronic gaming device can operate using either the conventional "third hand draw rules" or the modified "third hand draw rules" described above. The electronic gaming machine can also be programmed to allow the bettor to make separate side bets that can be paid either based on straight odds or tied into a progressive jackpot. All or the features described above in connection with the method of the present invention can be included in the electronic gaming machine.

It is expected that in actual operation of the present invention, the gaming establishment will increase its revenue from the practice of the present invention because the number of hands or rounds per hour will increase. This is due to the elimination of the commission collected by the gaming establishment—the time spent previously computing, accruing and recording the commission on the table layout will be eliminated, the possibility of errors arising from dealing with the commission will be eliminated and no lost revenue will exist because of bettor's tapping out and failing to pay their commission.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. An improved method of playing the conventional manner of play of Baccarat in which a bettor makes a wager that either a Bank hand or a Player hand will win, the improvement comprising:

a) preselecting one or more hand combinations of the Bank hand and the Player hand as barred combinations so that a normally winning hand becomes a push hand during a step of paying off;

b) dealing two cards comprising the Bank hand and dealing two cards comprising the Player hand according to the conventional manner of play of Baccarat;

c) dealing an additional card to the Player hand and an additional card to the Bank hand if required according to the conventional manner of play of Baccarat;

d) determining a winning hand and a losing hand according to the conventional manner of play of Baccarat;

e) determining whether a barred combination of the Bank hand and the Player hand exits by comparing the combination of the Bank hand and the Player hand to the hand combinations of the Bank hand and the Player hand that are preselected as barrel combinations;

f) if a barred combination of the Bank hand and the Player hand exists, treating the winning hand as a push by returning to the bettor the amount wagered on the winning hand without any pay off and collecting the amount wagered on the losing hand;

g) if a barred combination of the Bank hand and the Player hand does not exist, paying off the bettor a predetermined amount if the bettor has wagered on the winning hand and collecting the amount wagered on the losing hand.

2. The method of claim 1 in which the preselected barred hand combination is the Bank hand having a two card numerical total of either eight or nine and the Player hand having a numerical two card total of zero.

3. The method of claim 1 in which the preselected barred hand combination is the Bank hand and the Player hand combination as shown in the following table:

| BARS USING BANK HAND TOTALS<br>Winning Bank hand is barred when totals are: | |
|---|---|
| BANK HAND TOTAL IS: | PLAYER HAND TOTAL IS: |
| 9 or 8 (two cards only) | 0 |
| 9 (two or three cards) | 2, 3 |
| 8 (two or three cards) | 1, 2 |
| 7 (three cards only) | 0, 1, 2, 3, 4, 5, 6 |
| 6 (two cards only) | 0, 1, 2, 3 |
| 5 (two cards only) | 0, 1, 2, 3 |
| 4 (two or three cards) | 0, 1, 2 |
| 3 & 2 (two or three cards) | 0, 1, 2 |
| 1 & 2 & 3 & 4 (two or three cards) | 0 |

4. The method of claim 1 in which the preselected barred hand combination is the Bank hand and the Player hand combination as shown in the following table:

| BARS USING COLORS (RED OR BLACK)<br>Bank winning hand has all cards of the same color<br>Winning Bank hand is barred when totals are | |
|---|---|
| BANK HAND TOTAL IS: (two or three card hands all same color) | PLAYER HAND TOTAL IS: |
| 9 | 0, 1, 2, 3 |
| 8 | 0, 1, 2, 3 |
| 7 | 0, 1, 2, 3, 4, 5 |
| 6 | 0, 1, 2, 3, 4, 5 |
| 1 & 2 & 3 & 4 | 0, 1, 2, 3 |

5. The method of claim 1 in which the preselected barred hand combinations is the Bank hand and the Player hand combination as shown in the following table:

| BARS USING SUITS ♣ ♦ ♥ ♠<br>Bank winning hand has all cards of the same suit<br>Winning Bank hand is barred when: | |
|---|---|
| BANK HAND TOTAL IS: (two or three card hands all same suit) | PLAYER HAND TOTAL IS: |
| 9 | 0, 1, 2, 3, 4, 5, 6, 7, 8 |
| 8 | 0, 1, 2, 3, 4, 5, 6, 7 |
| 1 & 2 & 3 & 4 & 7 | 0, 1, 2, 3, 4, 5, 6 |
| 4 & 5 & 6 | 0, 1, 2, 3, 4, 5 |

6. The method of claim 1 in which the preselected barred hand combination is the Bank hand and the Player hand combination as shown in the following table:

| BARS USING PAIRS<br>Any winning Bank over a losing Player hand holding a two card pair and any two card winning Bank hand holding a pair over a losing Player hand is barred.<br>(All of the following combinations are used to make the bar). | |
|---|---|
| BANK HAND TOTAL IS: | PLAYER HAND TOTAL IS: |
| 7, 8, 9 | 6 (pair is 3, 3) |
| 7, 8, 9 | 6 (pair is 4, 4) |
| 9 | 8 (pair is 4, 4) |
| 9 | 8 (pair is 9, 9) |
| 4 (pair is 2, 2) | 0, 1, 2, 3 |
| 4 (pair is 7, 7) | 0, 1, 2, 3 |
| 6 (pair is 3, 3) | 0, 1, 2, 3, 4, 5 |
| 6 (pair is 8, 8) | 0, 1, 2, 3, 4, 5 |
| 8 (pair is 4, 4) | 0, 1, 2, 3, 4, 5, 6, 7 |
| 8 (pair is 9, 9) | 0, 1, 2, 3, 4, 5, 6, 7 |

7. The method of claim 1 in which the barred hand combination is preselected to occur with approximately the same statistical frequency as the percentage of commission collected according to the conventional manner of play of Baccarat.

8. The method of claim 1 in which the barred hand combination is preselected to occur with a statistical frequency determined by the gaming establishment.

9. The method of claim 1 further comprising:

a) the bettor making a second side bet wager that one or more pre-established arrangements of cards will occur during the conventional manner of play of Baccarat;

b) determining whether a pre-established arrangement of cards occurred during the conventional manner of play of Baccarat; and c) paying the bettor a predetermined amount if the bettor has made a winning wager on the pre-established arrangement of cards.

10. The method of claim 9 in which the pre-established arrangements of cards is that a push hand will occur.

11. The method of claim 9 in which the pre-established arrangements of cards is that a bar hand will occur.

12. The method of claim 9 in which the pre-established arrangements of cards is that all of the cards will be the same color.

13. The method of claim 9 in which the pre-established arrangements of cards is that all of the cards will be the same suit.

14. The method of claim 9 in which the pre-established arrangements of cards is that the Bank hand and the Player hand will be a natural tie.

15. The method of claim 9 in which the pre-established arrangements of cards is that either the Bank hand or the Player hand will be a natural.

16. The method of claim 9 in which the pre-established arrangements of cards is that either the Bank hand or the Player hand will be a natural nine and the other hand will be a natural eight.

17. The method of claim 9 in which the pre-established arrangements of cards is that either the Bank hand or the Player will be a numerical total of either eight or nine.

18. The method of claim 9 in which the pre-established arrangements of cards is that either the Bank hand or the Player hand will be a numerical total of nine and the other hand will be a numerical total of eight.

19. The method of claim 9 in which the pre-established arrangements of cards is the numerical total of the cards of the winning hand.

20. The method of claim 9 in which the pre-established arrangements of cards is the numerical total of all of the cards of both hands.

21. The method of claim 9 in which the pre-established arrangements of cards is that the Bank hand and the Player hand will comprise a pair of the same cards.

22. The method of claim 9 in which the pre-established arrangements of cards is either the Bank hand or the Player hand will comprise triplets of the same card.

23. The method of claim 9 in which the pre-established arrangements of cards is the Bank hand and the Player hand will comprise triplets of the same card.

24. The method of claim 9 in which the pre-established arrangements of cards is the winning hand will have cards all of the same suit.

25. The method of claim 9 in which the pre-established arrangements of cards is the number of cards used.

26. The method of claim 1 further comprising:

a) the bettor making a second side bet wager whether the total numerical point value of the cards comprising the winning hand are over or under a total numerical point value of five;

b) determining the total numerical point value of the winning hand; and c) paying the bettor a predetermined amount if the bettor has made a winning wager on whether the total numerical point value of the cards comprising the winning hand is over or under a total numerical point value of five.

27. The method of claim 9 in which the side bet wager is apportioned to a progressive jackpot and the bettor is paid a predetermined amount from the progressive jackpot if the Player hand or the Bank hand comprises a preselected arrangement of cards.

28. An improved method of playing the conventional manner of play of Baccarat in which a bettor makes a wager that either a Bank hand or a Player hand will win, the improvement comprising:

a) preselecting one or more hand combinations of the Bank hand and the Player hand as barred combinations so that a normally winning hand becomes a push hand during a step of paying off;

b) dealing two cards comprising the Bank hand and dealing two cards comprising the Player hand according to the conventional manner of play of Baccarat;

c) dealing an additional card to the Player hand and an additional card to the Bank hand if required according to the following third card draw rules:

1) both the Bank hand and the Player hand stands if the

Bank hand or the Player hand has a point total of 8 or 9;

2) the Bank hand stands on a point total of 6 or 7;

3) the Bank hand draws on a point total of 5 or less;

4) the Player hand stands on a point total of 6 or 7; and 5) the Player hand draws on a point total of 5 or less;

d) determining a winning hand and a losing hand according to the conventional manner of play of Baccarat;

e) determining whether a barred combination of the Bank hand and the Player hand exists by comparing the combination of the Bank hand and the Player hand to the hand combinations of the Bank hand and the Player hand that are preselected as barred combinations;

f) if a barred combination of the Bank hand and the Player hand exists, treating the winning hand as a push by returning to the bettor the amount wagered on the winning hand without any pay off and collecting the amount wagered on the losing hand;

g) if a barred combination of the Bank hand and the Player hand does not exist, paying off the bettor a predetermined amount if the bettor has wagered on the winning hand and collecting the amount wagered on the losing hand.

29. The method of claim 28 in which the preselected barred hand combination is the Bank hand having a two card numerical total of six and the Player hand having a two card numerical total of zero.

30. The method of claim 28 in which the preselected barred hand combination is the Player hand having a two card numerical total of six and the Bank hand having a two card numerical total of zero.

31. The method of claim 28 in which the preselected barred hand combination is the Bank hand and the Player hand combination as shown in the following table:

| BARS USING BOTH PLAYER AND BANK HAND TOTALS | | | |
|---|---|---|---|
| Winning Player hand is barred when totals are: | | Winning Bank hand is barred when totals are: | |
| PLAYER HAND TOTAL IS: | BANK HAND TOTAL IS: | PLAYER HAND TOTAL IS: | BANK HAND TOTAL IS: |
| 9 (two or three cards) | 8 | 9 (two or three cards) | 8 |
| 8 (two or three cards) | 5 | 8 (two or three cards) | 5 |
| 7 (two or three cards) | 0 | 7 (two or three cards) | 0 |
| 6 (two or three cards) | 0 | 6 (two or three cards) | 0 |
| 5 & 4 (two or three cards) | 0 | 5 & 4 (two or three cards) | 0 |
| 3 & 2 (two or three cards) | 0 | 3 & 2 (two or three cards) | 0 |
| 2 & 1 (two or three cards) | 0 | 2 & 1 (two or three cards) | 0 |

32. The method of claim 28 in which the preselected barred hand combination is the Bank hand and the Player hand combination as shown in the following table:

| BARS USING COLORS (RED OR BLACK) Bars for Both Player and Bank Hands | | | |
|---|---|---|---|
| Winning Player hand is barred when holding cards of the same color and totals are: | | Winning Bank hand is barred when holding cards of the same color and totals are: | |
| Player hand total is: | Bank hand total is: | Bank hand total is: | Player hand total is: |
| 9 (two cards same color) | 1 & 0 | 9 (two cards same color) | 1 & 0 |
| 8 (two cards same color) | 1 & 0 | 8 (two cards same color) | 1 & 0 |
| 7 (two cards same color) | 6 & 5 & 4 | 7 (two cards same color) | 6 & 5 & 4 |
| 6 (two cards same color) | 5 & 4 & 3 & 2 | 6 (two cards same color) | 5 & 4 & 3 & 2 |
| 6 & 5 (three cards same color) | 5 through 0 | 6 & 5 (three cards same color) | 5 through 0 |
| 4 & 3 & 2 (three cards same color) | 3 through 0 | 4 & 3 & 2 (three cards same color) | 3 through 0 |

33. The method of claim 28 in which the preselected barred hand combination is the Bank hand and the Player hand combination as shown in the following table:

| BARS USING SUITS , , , Bars for Both Player and Bank Hands | | | |
|---|---|---|---|
| Winning Player hand is barred when holding cards of the same suit and totals are: | | Winning Bank hand is barred when holding cards of the same suit and totals are: | |
| Player hand total is: | Bank hand total is: | Bank hand total is: | Player hand total is: |
| 9 (two cards same suit) | 8 through 3 | 9 (two cards same suit) | 8 through 3 |
| 8 (two cards same suit) | 7 through 3 | 8 (two cards same suit) | 7 through 3 |
| 7 (two cards same suit) | 6 through 0 | 7 (two cards same suit) | 6 through 0 |
| 6 (two/three cards same suit) | 5 through 0 | 6 (two/three cards same suit) | 5 through 0 |
| 9 & 8 & 7 & 6 & 5 & 4 & 3 & 2 & 1 (three cards same suit) | 8 through 0 (losing hands) | 9 & 8 & 7 & 6 & 5 & 4 & 3 & 2 & 1 (three cards same suit) | 8 through 0 (losing hands) |

34. The method of claim 28 in which the preselected barred hand combination is the Bank hand and the Player hand combination as shown in the following table:

| BARS USING PAIRS<br>Any winning Player hand over a losing Bank hand holding a two card pair<br>and<br>Any winning Bank hand over a losing Player hand holding a two card pair. | | | |
|---|---|---|---|
| (All of the following combinations are used to make the bar) | | (All of the following combinations are used to make the bar) | |
| PLAYER HAND TOTAL IS: | BANK HAND TOTAL IS: | PLAYER HAND TOTAL IS: | BANK HAND TOTAL IS: |
| 9 through 3 | 2 (pair is 1, 1) | 9 through 3 | 2 (pair is 1, 1) |
| 9 through 5 | 4 (pair is 2, 2) | 9 through 5 | 4 (pair is 2, 2) |
| 9 & 8 & 7 | 6 (pair is 3, 3) | 9 & 8 & 7 | 6 (pair is 3,3) |
| 9 | 8 (pair is 4, 4) | 9 | 8 (pair is 4, 4) |
| 9 through 1 | 0 (pair is 5, 5) | 9 through 1 | 0 (pair is 5, 5) |
| 9 through 3 | 2 (pair is 6, 6) | 9 through 3 | 2 (pair is 6, 6) |
| 9 through 5 | 4 (pair is 7, 7) | 9 through 5 | 4 (pair is 7, 7) |
| 9 & 8 & 7 | 6 (pair is 8, 8) | 9 & 8 & 7 | 6 (pair is 8, 8) |
| 9 | 8 (pair is 9, 9) | 9 | 8 (pair is 9, 9) |

35. The method of claim 28 in which the barred hand combination is preselected to occur with approximately the same statistical frequency as the percentage of commission collected according to the conventional manner of play of Baccarat.

36. The method of claim 28 in which the barred hand combination is preselected to occur with a statistical frequency determined by the gaming establishment.

37. The method of claim 28 further comprising:

a) the bettor making a second side bet wager that one or more pre-established arrangements of cards will occur during the conventional manner of play of Baccarat;

b) determining whether a pre-established arrangement of cards occurred during the conventional manner of play of Baccarat; and c) paying the bettor a predetermined amount if the bettor has made a winning wager on the pre-established arrangement of cards.

38. An improved method of playing the conventional manner of play of Baccarat in which a bettor makes a wager that either a barred hand or a Player hand will win, the improvement comprising:

a) including one or more NO VALUE cards in a deck of playing cards used in the conventional manner of play of Baccarat so that if a NO VALUE card appears during the play of Baccarat a normally winning hand becomes a push hand during a step of paying off;

b) dealing two cards comprising the Bank hand and dealing two cards comprising the Player hand according to the conventional manner of play of Baccarat;

c) dealing an additional card to the Bank hand and an additional card to the Player hand if required according to the conventional manner of play of Baccarat;

d) determining a winning hand and a losing hand according to the conventional manner of play of Baccarat;

e) determining whether a NO VALUE card has appeared during the play of Baccarat;

f) if a NO VALUE card does not appear during the conventional manner of play of Baccarat, paying off the bettor a predetermined amount if the bettor has wagered on the winning hand and collecting the amount wagered on the losing hand;

g) if a NO VALUE card does appear during the play of Baccarat, treating the winning hand as a push by returning to the bettor the amount wagered on the winning hand without any pay off and collecting the amount wagered on the losing hand.

39. The method of claim 38 in which a NO VALUE card is included in the deck of playing cards so that a NO VALUE card will occur with approximately the same statistical frequency as the percentage of commission collected according to the conventional manner of play of Baccarat.

40. The method of claim 38 in which a NO VALUE card is included in the deck of playing cards so that a NO VALUE card will occur with a statistical frequency determined by the gaming establishment.

41. The method of claim 38 further comprising:

a) the bettor making a second side bet wager that one or more pre-established arrangements of cards will occur during the conventional manner of play of Baccarat;

b) determining whether a pre-established arrangement of cards occurred during the conventional manner of play of Baccarat; and c) paying the bettor a predetermined amount if the bettor has made a winning wager on the pre-established arrangement of cards.

42. An improved method of playing the conventional manner of play of Baccarat in which a bettor makes a wager that either a Bank hand or a Player hand will win, the improvement comprising:

a) including one or more NO VALUE cards in a deck of playing cards used in the conventional manner of play of Baccarat so that if a NO VALUE card appears during the play of Baccarat a normally winning hand becomes a push hand during a step of paying off;

b) dealing two cards comprising the Bank hand and dealing two cards comprising the Player hand according to the conventional manner of play of Baccarat;

c) dealing an additional card to the Bank hand and an additional card to the Player hand if required according to the following third card draw rules:

1) both the Bank hand and the Player hand stands if the Bank hand or the Player hand has a point total of 8 or 9;

2) the Bank hand stands on a point total of 6 or 7;

3) the Bank hand draws on a point total of 5 or less;

4) the Player hand stands on a point total of 6 or 7; and 5) the Player hand draws on a point total of 5 or less;

d) determining a winning hand and a losing hand according to the conventional manner of play of Baccarat;

e) determining whether a NO VALUE card has appeared during the play of Baccarat;

f) if a NO VALUE card does not appear during the conventional manner of play of Baccarat, paying off the bettor a predetermined amount if the bettor has wagered on the winning hand and collecting the amount wagered on the losing hand;

g) if a NO VALUE card does appear during the play of Baccarat, treating the winning hand as a push by returning to the bettor the amount wagered on the winning hand without any pay off and collecting the amount wagered on the losing hand.

43. The method of claim 42 in which a NO VALUE card is included in the deck of playing cards so that a NO VALUE card will occur with approximately the same statistical frequency as the percentage of commission collected according to the conventional manner of play of Baccarat.

44. The method of claim 42 in which a NO VALUE card is included in the deck of playing cards so that a NO VALUE card will occur with a statistical frequency determined by the gaming establishment.

45. The method of claim 42 further comprising:

a) the bettor making a second side bet wager that one or more pre-established arrangements of cards will occur during the conventional manner of play of Baccarat;

b) determining whether a pre-established arrangement of cards occurred during the conventional manner of play of Baccarat; and c) paying the bettor a predetermined amount if the bettor has made a winning wager on the pre-established arrangement of cards.

46. An improved method of playing the conventional manner of play of Baccarat in which a bettor makes a wager that either a Bank hand or a Player hand will win, the improvement comprising:

a) determining whether a Bank hand will be barred in the conventional manner of play of Baccarat so that a normally winning Bank hand becomes a push hand during a step of paying off;

b) dealing two cards comprising the Bank hand and dealing two cards comprising the Player hand according to the conventional manner of play of Baccarat;

c) dealing an additional card to the Bank hand and an additional card to the Player hand if required according to the conventional manner of play of Baccarat;

d) determining if the Bank hand is a winning hand according to the conventional manner of play of Baccarat;

e) if it has been determined that the Bank hand will not be barred and the Bank hand is the winning hand, paying the bettor a predetermined amount if the bettor has wagered on the winning hand and collecting the amount wagered on the losing hand; and f) if it has been determined that a normally winning Bank hand will be barred and the Bank hand is the winning hand, treating the Bank hand as a push by returning to the bettor the amount wagered on the Bank hand without any pay off and collecting the amount wagered on the losing hand.

47. The method of claim 46 in which the step of determining if the Bank hand is barred is made by using dice.

48. The method of claim 47 in which three dice are used and a normally winning Bank hand will be barred if any one of the following combinations of dice are rolled: three ①'s, three ②'s, three ③'s, three ④'s or three ⑤'s, ①-①-③ or ①-②-②.

49. The method of claim 46 in which the step of determining if the Bank hand is barred is made by using a mechanical wheel.

50. The method of claim 49 in which the mechanical wheel is provided with a plurality of stopping locations some of which are designated as "bar" locations and the rest of which are designated as "no-bar" locations, and a normally winning Bank hand will be barred whenever the mechanical wheel stops on a "bar" locations.

51. The method of claim 46 in which the step of determining if the Bank hand is barred is made by using a mechanical device that randomly determines whether a normally winning Bank hand would be barred.

52. The method of claim 46 in which the step of determining if the Bank hand is barred is made by using an electrical device that randomly determines whether a normally winning Bank hand would be barred.

53. The method of claim 46 in which the step of determining if the Bank hand is barred is preselected to occur with approximately the same statistical frequency as the percentage of commission collected according to the conventional manner of play of Baccarat.

54. The method of claim 46 in which the step of determining if the Bank hand is preselected to occur with a statistical frequency determined by the gaming establishment.

55. An improved method of playing the conventional manner of play of Baccarat in which a bettor makes a wager that either a Bank hand or a player hand will win, the improvement comprising:

a) determining whether a winning hand will be barred in the conventional manner of play of Baccarat so that a normally winning hand becomes a push hand during a step of paying off;

b) dealing two cards comprising the Bank hand and dealing two cards comprising the Player hand according to the conventional manner of play of Baccarat;

c) dealing an additional card to the Player hand and an additional card to the Bank hand if required according to the following third card draw rules:

1) both the Bank hand and the Player hand stands if the Bank hand or the Player hand has a point total of 8 or 9;

2) the Bank hand stands on a point total of 6 or 7;

3) the Bank hand draws on a point total of 5 or less;

4) the Player hand stands on a point total of 6 or 7; and 5) the Player hand draws on a point total of 5 or less;

d) determining if the Bank hand or the Player hand is a winning hand according to the conventional manner of play of Baccarat;

e) if it has been determined that the winning hand will not be barred, paying the bettor a predetermined amount if the bettor has wagered on the winning hand and collecting the amount wagered on the losing hand; and f) if it has been determined that the winning hand will be barred, treating the winning hand as a push by returning to the bettor the amount wagered on the winning hand without any pay off and collecting the amount wagered on the losing hand.

56. The method of claim 55 in which the the step of determining if the Bank hand is barred is made by using dice.

57. The method of claim 56 in which three dice are used and a normally winning Bank hand will be barred if any one of the following combinations of dice are rolled: three ①'s, three ②'s, three ③'s, three ④'s, three ⑤'s or three ⑥'s.

58. The method of claim 55 in which the of determining if the Bank hand is barred is made by using a mechanical wheel.

59. The method of claim 58 in which the mechanical wheel is provided with a plurality of stopping locations some of which are designated as "bar" locations and the rest of which are designated as "no-bar" locations, and a normally winning Bank hand will be barred whenever the mechanical wheel stops on a "bar" locations.

60. The method of claim 55 in which the step of determining if the Bank hand is barred is made by using a mechanical device that randomly determines whether a normally winning Bank hand would be barred.

61. The method of claim 55 in which the step of determining if the Bank hand is barred is made by using an electrical device that randomly determines whether a normally winning Bank hand would be barred.

62. The method of claim 55 in which the step of determining if the Bank hand is barred is preselected to occur with approximately the same statistical frequency as the percentage of commission collected according to the conventional manner of play of Baccarat.

63. The method of claim 55 in which the step of determining if the Bank hand is preselected to occur with a statistical frequency determined by the gaming establishment.

* * * * *